United States Patent [19]

Deters

[11] 4,310,033

[45] Jan. 12, 1982

[54] LIQUID DISPENSING AND UPHILL VAPOR RECOVERY SYSTEM

[75] Inventor: Elmer M. Deters, Muscatine, Iowa

[73] Assignee: The Marley-Wylain Company, Mission, Kans.

[21] Appl. No.: 101,520

[22] Filed: Dec. 10, 1979

[51] Int. Cl.[3] ..... B65B 3/18; B65B 31/00

[52] U.S. Cl. ..... 141/44; 141/59

[58] Field of Search ..... 141/7, 44, 45, 52, 59, 141/285, 290

[56] References Cited

U.S. PATENT DOCUMENTS

| | | | |
|---|---|---|---|
| 3,081,915 | 3/1963 | Patterson et al. | 222/333 |
| 3,905,405 | 9/1975 | Fowler et al. | 141/59 X |
| 3,981,334 | 9/1976 | Deters | 141/59 X |

*Primary Examiner*—Frederick R. Schmidt

*Attorney, Agent, or Firm*—Lane, Aitken, Kice & Kananen

[57] ABSTRACT

A liquid dispensing and vapor recovery system designed to be utilized in gasoline stations, or the like, in which the gasoline is pumped from a storage tank, through a first conduit system, and to each of several dispensing units for dispensing the gasoline to the vehicle tanks. A portion of the gasoline at each dispensing unit is diverted from the first conduit system into a second conduit system before it passes to the dispensing nozzle, and means are responsive to the gasoline flow through the second conduit system for drawing vapors from the receptacle into the second conduit system. A sump tank is connected to the second conduit system for receiving the mixture of diverted gasoline and vapor, and means are provided which are responsive to the operation of the pump for drawing the diverted gasoline from the sump tank to an additional conduit for passage back into the storage tank.

8 Claims, 4 Drawing Figures

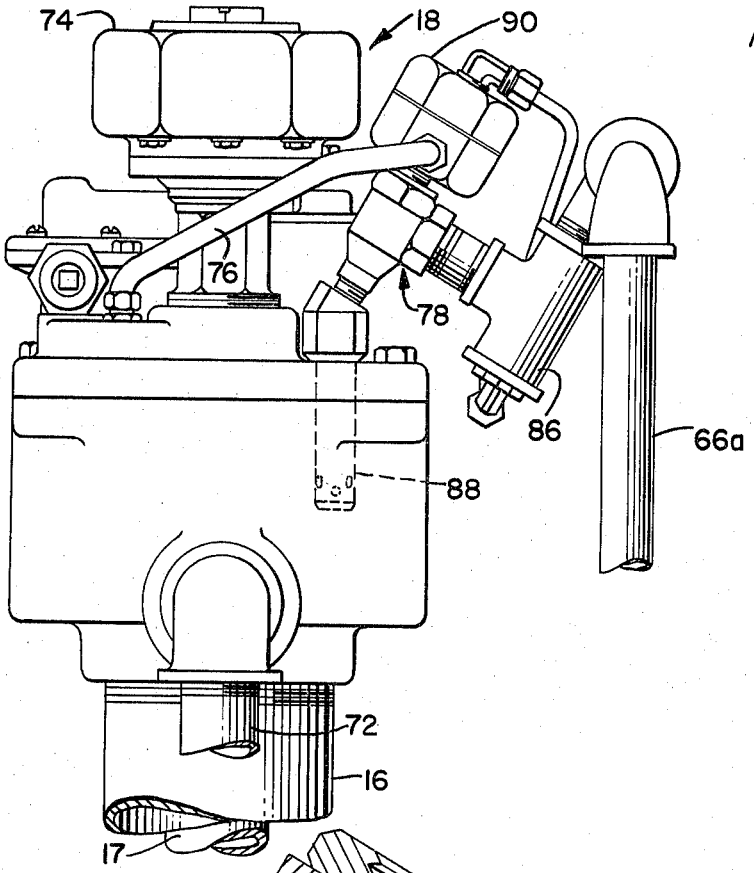
FIG. 3.
FIG. 2.
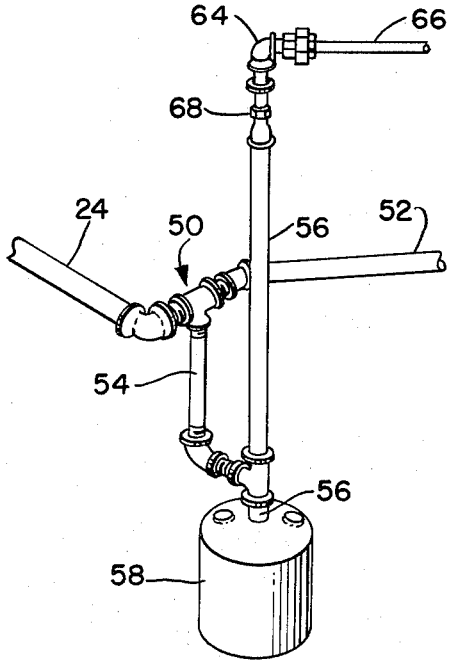
FIG. 4.
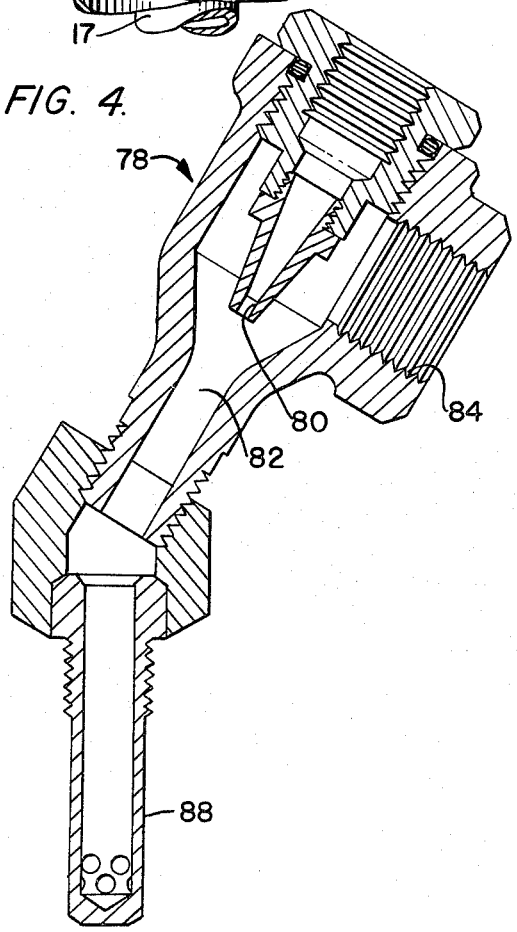

LIQUID DISPENSING AND UPHILL VAPOR RECOVERY SYSTEM

BACKGROUND OF THE INVENTION

This invention relates to a liquid dispensing and vapor recovery system and, more particularly, to such a system in which liquid is dispensed from a storage tank to a receptacle while vapors from the receptacle are passed to the storage tank.

With the increased emphasis on preventing pollution of the atmosphere, recent attention has been directed to minimizing the introduction of gasoline vapors into the atmosphere from both permanent type underground storage tanks for the gasoline, and from the vehicles into which the gasoline is dispensed.

Gasoline vapors can easily be recovered from underground storage tanks by providing a separate vapor return line which connects the storage tank to the transport truck which periodically fills the tank. In this manner, the gasoline introduced into the tank from the transport truck will displace the vapors and force them through the vapor recovery line to the truck whereby they are ultimately disposed of either by burning or through compression-refrigeration systems.

In each of U.S. Pat. Nos. 3,905,405; 3,915,206; 3,913,633; 3,941,468; 3,952,781; 3,981,334 and 3,981,335, all of which are assigned to the same assignee of the present invention, a gasoline dispensing and vapor recovery system is disclosed which enables a very high percentage of vapor recovery from automobile fuel tanks to be achieved. In these arrangements an eductor (also termed an "injector" or "aspirator") is provided which establishes a reduced pressure zone in response to fluid flow from the storage tank to the vehicle tank, with the reduced pressure zone functioning to draw the vapors from the receptacle back to the tank.

Since these arrangements are designed for installations in which the storage tank can be located a distance below the dispensers so as to accommodate the proper (approximately ⅛ inch per foot) slope therebetween to enable the gasoline utilized in the aspirator to flow by gravity back to the storage tank, problems are created when, due to limitations in the terrain and other related factors, such a slope cannot be maintained. In large installations, where many dispensers are utilized and where there may be as much as 200 feet between the tank and some of the dispensers, this problem is especially acute. In addition, when all of the dispensers of a multi-dispenser installation are operating at the same time, it is difficult for a single standard return line to accommodate the high volume of vapor and gasoline passing through the aspirator.

SUMMARY OF THE INVENTION

It is therefore an object of the present invention to provide a liquid dispensing and vapor recovery system which incorporates the advantages of the systems described above yet is adaptable to installations in which the optimum vertical spacing between the storage tank and the dispensing units is not available.

It is a further object of the present invention to provide a liquid dispensing and vapor recovery system of the above type in which a system incorporating several dispensing units can be accommodated by a standard size vapor recovery line.

Toward the fulfillment of these and other objects, the system of the present invention includes first conduit means adapted to connect a storage tank to the dispensing units and second conduit means connected to the first conduit means for diverting a portion of the liquid from the first conduit means. An aspirator is provided which is responsive to liquid flow through the second conduit means for drawing the vapor from the vapor receptacle into the second conduit means. A sump tank is connected to the second conduit means for receiving the diverted liquid and third conduit means connects the sump tank to the storage tank. The diverted liquid from the sump tank is passed via the third conduit means into the storage tank in response to operation of the pump.

BRIEF DESCRIPTION OF THE DRAWINGS

FIG. 2 is a partial, enlarged, elevational view of a portion of the system of FIG. 1.;

FIG. 3 is an enlarged elevational view depicting a component of the system of FIG. 1; and FIG. 4 is an enlarged, longitudinal sectional view of a portion of the component of FIG. 3.

DESCRIPTION OF THE PREFERRED EMBODIMENT

Figure 1:
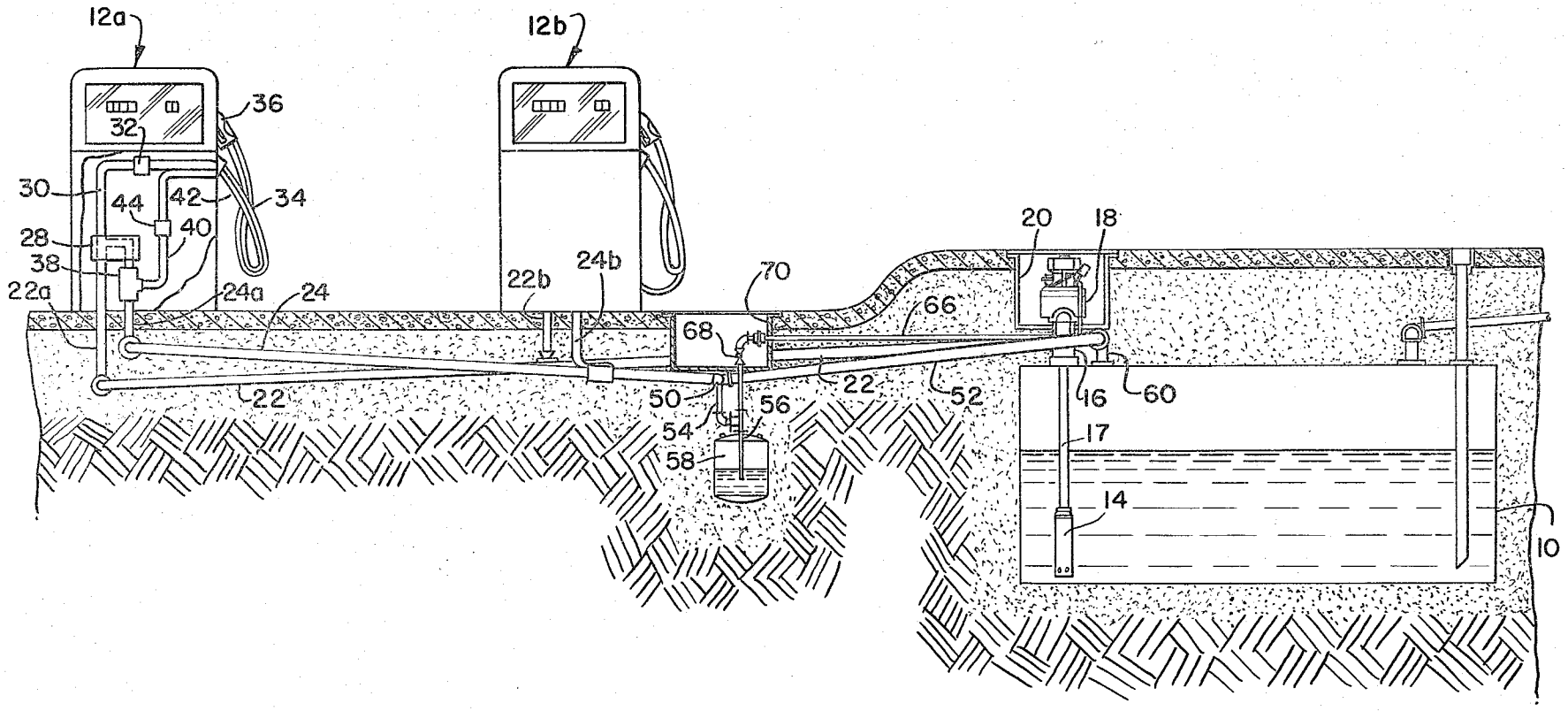
FIG. 1 is a partial schematic, partial elevational view of a service station installation incorporating the liquid dispensing and vapor recovery system of the present invention.

As an example of the use of the liquid dispensing and vapor recovery system of the present invention, it will be described in connection with a gasoline dispensing installation for use in service stations or the like. Such an installation is illustrated in FIG. 1 and includes an underground tank 10 for storing a quantity of gasoline which is delivered to two dispensing units or pedestals 12*a* and 12*b*, it being understood that in large installations several more dispensing units of the type shown would be provided.

An electrically operated, submersible turbine pump 14 is provided in the storage tank 10 and operates to draw the gasoline from the tank through a plurality of intake ports disposed at the bottom of the pump and to force the gasoline upwardly around a sealed electrical drive motor.

A casing 16 is attached to the tank 10 and extends upwardly therefrom to connect a delivery pipe 17, which is attached to the outlet of the pump 14, to a discharge head, or manifold 18 which is preferably disposed just below ground level in a well 20. The basic manifold 18 is described in detail in U.S. Pat. No. 3,183,723, the disclosure of which is hereby incorporated by reference, and has been modified slightly for the purposes of the present invention as will be described in detail later. Although not clear from the drawings, it is understood that the manifold 18 has an inlet chamber communicating with the outlet of the pump 14 and an outlet chamber adapted for registration with a substantially horizontal main conduit 22. Also, a check valve (not shown) is provided in the manifold to permit the flow of gasoline from the pump 14 to the conduit 22 while preventing flow in the opposite direction.

A pair of substantially vertical branch conduits 22*a* and 22*b* connect the main conduit 22 to the pedestals 12*a* and 12*b*, respectively, for delivering the gasoline to the pedestals. A pair of substantially vertical vapor return branch conduits 24*a* and 24*b* are associated with the pedestals 12*a* and 12*b*, respectively, and connect to a main vapor recovery conduit 24.

The internal components of the pedestal 12*a* are shown in FIG. 1 and since these components are completely disclosed and described in the aforementioned U.S. Pat. No. 3,981,334, they will only be described generally as follows.

The branch conduit 22*a* is connected to a control unit 28 and a conduit 30 connects the outlet of the control unit to a meter 32 permitting a portion of the gasoline from the conduit 22*a* to be passed through the meter and to a gasoline dispensing hose 34 which is connected to a dispensing nozzle 36. The control unit 28 is adapted to divert a portion of the gasoline received from the conduit 22*a* through an injector, or eductor, 38 and to the vapor return conduit 24*a*. The control unit 28 also prevents the flow of liquid back to the storage tank 10 until gasoline is delivered to the nozzle 36 and modulates the vapor flow back to the storage tank in response to flow through the conduit 22. The eductor 38 operates in a manner specifically described in the latter cited patent to form a reduced pressure zone upon a flow of the diverted gasoline therethrough, which reduced pressure zone is connected, via a line 40, to a hose 42 juxtapositioned relative to the hose 34 and also connected to the dispensing nozzle 36.

A valve 44 is provided in the line 40 for permitting vapor flow from the hose 42 through the line 40 and to the eductor 38 but preventing gasoline flow in the opposite direction. Although not shown in the drawings, it is understood that pedestal 12*b* and the other pedestals in the installation contain the same components and operate in the same manner as the pedestal 12*a*.

It can be appreciated from the foregoing that upon an operator placing the dispensing nozzle 36 in a vehicle gasoline tank and actuating the pump 14 through an appropriate switch, the pump will operate to discharge gas through the manifold 18, the conduit 22 and the branch conduit 22*a* where the gasoline flows through the control unit 28, the line 30 and to the hose 34 for discharge into the vehicle tank. Upon passage of the gasoline through the control unit 28, a portion of the gasoline is diverted through the line 24*a* and the eductor 38. The eductor 38 operates to draw vapor from the vehicle tank, the dispensing nozzle 36, the hose 42, the conduit 40 and into and through the eductor 38. The mixture of the diverted gas and the vapor in the eductor 38 passes through the conduit 24*a* and into the main vapor return conduit 24.

As indicated above, under ideal conditions, this type of installation would be such that the conduit 24 would be sloped in the proper manner (approximately $\frac{1}{8}$ inch per foot) from the pedestals 12*a* and 12*b* to the upper portion of the storage tank 10 in order to enable the diverted gasoline in the conduit 24 to flow by gravity to the tank. However, in large installations and/or due to an unusual terrain or the like, it is often impossible to maintain this type of slope. Therefore, according to the present design, and as shown in FIG. 1, the conduit 24 extends to a location that is less than the full distance to the storage tank 10. More particularly, the conduit 24 terminates at a T-connection 50 which is shown in greater detail in FIG. 2 and which connects the conduit 24 with a vapor return conduit 52 and with a gasoline return conduit 54. The vapor return conduit 52 extends at a slight angle to the horizontal as shown in FIG. 1, and the gasoline return conduit 54 extends vertically and is connected by the fittings shown to a vertical conduit 56 extending into a sump tank 58.

In this manner, when the mixture of gasoline and vapor pass through the conduit 24 by gravity to the T-connection 50, the gasoline will drop, via the conduit 54, into the tank 58 while the vapor will continue to flow by natural convection through the conduit 52 to a fitting 60 (FIG. 1) which is located at the top of the storage tank and which permits the vapors to discharge into the tank. It is noted that the conduit 52 is sloped in an upward direction from the T-connection 50 to the storage tank 10, but this is of no consequence due to the natural convection flow.

The vertical conduit 56 extends above the connection to the conduit 54 and is connected by an elbow 64 to a horizontal conduit 66, with a check valve 68 being provided in the conduit 56. The conduit 66 has a vertical branch portion 66*a* shown in the enlarged view of FIG. 3 which is connected to the manifold 18. The upper portion of the conduit 56, the check valve 68 and the elbow 64 are all located in a well 20 disposed just below ground level as shown in FIG. 1.

The manifold 18 (FIG. 3) includes an inlet for receiving the gasoline from the pump 14 with the delivery pipe 17 of the latter extending through the casing 16, and a discharge conduit 72 which is connected to the gasoline delivery conduit 22. A leak detector 74 is provided on the upper portion of the manifold 18 and since it is fully disclosed in the abovecited U.S. Pat. No. 3,183,723, and does not form any part of the present invention, it will not be described in any further detail.

A portion of the gas flow passing from the delivery conduit of the pump 14 to the discharge conduit 72 of the manifold is diverted inside the manifold 18 to a conduit 76 which is connected to an eductor shown in general by the reference numeral 78 in FIG. 3 and in detail in FIG. 4. The eductor 78 includes a nozzle 80 which receives the diverted gas flow from the conduit 76 and discharges same into a venturi area to create a low pressure zone 82 which is connected, via an inlet 84 and a fitting 86 (FIG. 3) to the branch conduit 66*a* which, in turn, is connected to the sump tank 58 by the conduits 66 and 56. The eductor 78 also includes a perforated discharge tube 88 for discharging the mixture of diverted gas and vapor into a chamber in the manifold 18 which communicates with the casing 16 and therefore the storage tank 10.

Upon operation of the pump 14, gasoline is passed through the manifold 18 where a large portion of it discharges through the discharge conduit 72 to the conduit 22 for passage to the pedestals 12*a*, 12*b*, etc. A portion of the gasoline in the manifold 18 is diverted through the conduit 76 and passes through the eductor 78 to create a low pressure zone. Gasoline is thus drawn from the sump tank 58 through the lines 56, 66 and 66*a*, and through the inlet 84 of the eductor 78 into the low pressure zone 82 where it mixes with the diverted gasoline and flows through the discharge tube 88 and the casing 16 and back to the storage tank 10. The check valve 68 (FIG. 2), disposed in the conduit 56 maintains liquid in the line 66 in the event the pump 14 and therefore the eductor 78 cease to operate.

A pressure relief valve 90 is provided immediately above the eductor 78 and in communication with the conduit 76 to maintain a back pressure in the line since proper operation of the leak detector 74 requires a positive pressure in the system at all times.

It can be appreciated that the sump tank 58 will establish a reservoir in the event several eductors 38 from the pedestals 12*a*, 12*b*, etc. are discharging the mixture of diverted gasoline and vapor into the return line 24 via the vertical branch lines 24*a*, 24*b*, etc. This multiple discharge into the sump tank 58 can be accommodated by the latter even though the eductor 78 does not draw an equal amount from the tank 58.

It is understood that, although the present invention has been described in connection with a gasoline dispensing and vapor recovery system, it is also applicable to other systems, such as those utilized in chemical plants, or the like.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention.

What is claimed is:

1. A liquid dispensing and vapor recovery system comprising storage means for said liquid, dispensing means for dispensing said liquid to a receptacle, first conduit means adapted to connect said storage means to said dispensing means, pump means for pumping said liquid from said storage means through said first conduit means and to said dispensing means, second conduit means connected to said first conduit means for diverting a portion of said liquid from said first conduit means, means responsive to liquid flow through said second conduit means for drawing the vapors from said receptacle into said second conduit means, a sump tank connected to said second conduit means for receiving said diverted liquid, third conduit means connecting said second conduit means to said storage tank for conveying vapor from said second conduit means to said storage tank, fourth conduit means connecting said sump tank to said storage tank, and means responsive to the operation of said pump for passing the diverted liquid from said sump tank to said fourth conduit means for passage into said storage tank.

2. The system of claim 1 wherein said passing means creates a low pressure zone in said fourth conduit means for drawing the diverted liquid from said sump tank to said fourth conduit means.

3. The system of claim 2 wherein said passing means includes an eductor located in said fourth conduit means for receiving a portion of the liquid from said pump and creating said low pressure zone.

4. In a liquid dispensing and vapor recovery system in which liquid is pumped from a storage tank to a dispensing unit for discharge into a receptacle while a portion of the liquid is diverted through an eductor to create a low pressure zone to draw vapors from the receptacle to the eductor; wherein the improvement comprises:

first conduit means connected to said eductor for receiving the diverted liquid and vapor, a sump tank communicating with said first conduit means for receiving the liquid from said first conduit means, second conduit means connecting said sump tank to said storage tank, means responsive to the pumping of said liquid for drawing the diverted liquid from said sump tank to said second conduit means for passage into said storage tank, and means for conveying said vapor from said sump tank to said storage tank separately from said liquid.

5. The system of claim 4 wherein said drawing means creates a low pressure zone in said second conduit means.

6. The system of claim 5 wherein said drawing means includes an eductor located in said second conduit means for receiving a portion of the liquid from said pump and creating said low pressure zone.

7. The system of claim 4 wherein said conveying means comprises third conduit means connected to said first conduit means and to said storage tank for conveying said vapors to said storage tank.

8. The system of claim 7 further comprising fourth conduit means connecting said first conduit means to said sump tank, said fourth conduit means extending downwardly from said first conduit means to said sump tank, whereby a gravity separation of said liquid from said vapor is effected.

* * * * *